428-408 SR
7/26/83 XR 4,395,458

United States Patent [19]
Huang

[11] 4,395,458
[45] Jul. 26, 1983

[54] GRAPHITE IMPREGNATED POLYAMIDE TENNIS STRINGS

[76] Inventor: Ben T. Huang, 16652 Gemini La., Huntington Beach, Calif. 92647

[21] Appl. No.: 293,529

[22] Filed: Aug. 17, 1981

[51] Int. Cl.[3] ..... B32B 9/00; D02G 3/04; D02G 3/36

[52] U.S. Cl. ..... 428/367; 428/372; 428/373; 428/397; 428/408; 428/407; 428/475.5; 156/244.11; 57/250; 57/258; 57/231

[58] Field of Search ..... 428/372, 373, 367, 397, 428/408, 407, 475.5; 57/250, 258, 231

[56] References Cited

U.S. PATENT DOCUMENTS

| | | | |
|---|---|---|---|
| 4,045,949 | 9/1977 | Paton et al. | 428/367 X |
| 4,061,827 | 12/1977 | Gould | 428/367 X |
| 4,084,399 | 4/1978 | Kanemaru et al. | 428/367 X |
| 4,275,117 | 6/1981 | Crandall | 428/373 |
| 4,300,343 | 11/1981 | Makamura | 428/373 X |

*Primary Examiner*—P. Ives
*Attorney, Agent, or Firm*—Fulwider, Patton, Rieber, Lee & Utecht

[57] ABSTRACT

For use in a stringed apparatus, such as a tennis racket, a synthetic string having a cross-sectional diameter between about 0.025 and about 0.08 inch and comprising a plurality of fused, entwined filaments which are composed of a polyamide, such as nylon, impregnated with from about 0.05 to about 2.0 weight percent graphite particles having cross-sectional diameters ranging from about 0.1 to about 2.0 microns. To make the string, polyamide is heated to a temperature between about 300° and 550° F., preferably between about 450° and 500° F., mixed with graphite particles present at a concentration sufficient to promote cross-linkage of the polyamide substantially in the absence of cleavage, filtered, nozzle extruded into filaments, cooled, prestressed, and then fused into a string. A string having a cross-sectional diameter between about 0.05 and 0.06 inch exhibits a tensile strength greater than about 60,000 psi, modulus of elasticity less than about $0.3\times10^6$ psi, and an elongation less than about 18.0 percent at the tension of the breaking point.

14 Claims, 5 Drawing Figures

GRAPHITE IMPREGNATED POLYAMIDE TENNIS STRINGS

BACKGROUND OF THE INVENTION

This invention relates generally to synthetic strings, such as those used for sport rackets and musical instruments, and, more particularly, to a string suitable for use in a tennis racket.

For many years substantially all strings for stringed apparatus were composed of tissue or other animal components. For example, animal intestine, known as animal gut, was the primary string in tennis rackets. Indeed, although numerous synthetic tennis racket strings have been developed, many players still consider gut the superior tennis racket string. A principal advantage of gut is its "feel," which is believed to extend from the fact that it operates with less internal damping than many other materials, thus causing the ball to rebound harder from the racket, while minimizing energy loss due to impact. In other words, gut has high-resilience characteristics, i.e., low-damping qualities. However, gut also has a number of disadvantages, such as high cost, variable quality, modest strength and durability, and, perhaps most importantly, an inability to withstand high-moisture environments for a significant length of time.

These disadvantages have initiated an extensive search for alternative strings. Due to good durability and good resistance to moisture, a variety of synthetic polymers have been formed into strings for use in tennis rackets. These synthetic strings have not proved entirely satisfactory, however, because they generally lack the low damping of gut and sometimes elongate when exposed to higher temperatures, thus losing the necessary tension in the stringed racket.

In recent years, increasing interest has focused on the need for improved synthetic strings and their production. Such interest has been intensified by the soaring requirements in the tennis racket industry for high performance strings. For instance, the immense popularity of oversized tennis rackets, which generally must be strung at higher tensions than regular-sized tennis rackets to maintain good playing characteristics, has generated significant research efforts in the art.

Therefore, there is a recognized need for an improved synthetic tennis string having low internal damping, minimal elongation, high tensile strength and good playing characteristics. The present invention fills this need.

SUMMARY OF THE INVENTION

The present invention provides a string composition and method of making that substantially increases the tensile strength and reduces elongation of the string, while maintaining high resiliency. Moreover, the string composition of the present invention is relatively inexpensive to manufacture, is substantially water resistant, and significantly retains its improved characteristics even when strung at high tension in over-sized tennis rackets.

One aspect of the invention resides in a string having a cross-sectional diameter from about 0.025 to about 0.08 inch and comprising a plurality of filaments containing graphite particles to increase the tensile strength of said filament. The string is composed of about 49 to 79 synthetic polymer filaments, made from a substantially linear polyamide, such as a nylon. The graphite particles, which range in size from 0.01 to about 2.0 microns, are present in a concentration sufficient to promote cross-linking substantially in the absence of cleavage. A suitable range is from about 0.05 to about 2.0 weight percent, preferably 0.50 to about 1.5 weight percent, and most preferred 0.9 weight percent.

More particularly, a string constructed in accordance with the present invention is especially suitable for use in tennis rackets. A tennis string having a cross-sectional diameter between about 0.05 and about 0.06 inch comprising a plurality of entwined, fused filaments, which range in size from about 0.003 to about 0.01 inch and are composed of a polyamide impregnated with graphite particles, exhibits a tensile strength greater than about 60,000 psi, a modulus of elasticity less than about $0.3\times10^6$ psi, and an elongation less than about 18% at the tension of the breaking point. A tennis racket string having a cross-sectional diameter of about 0.054 inch and having 79 filaments composed of a nylon impregnated with 0.9 weight percent graphite particles, which have a diameter ranging from about 0.1 to about 2.0 microns, exhibits a tensile strength of 63,900 psi, an elongation of about 17.1% at the tension of the breaking point, a modulus of elasticity of about $0.268\times10^6$ psi, and loss coefficient of about 7.5% at 50 lbs., 9.8 percent at 60 lbs., 11 percent at 70 lbs., and 11.5 percent at 80 lbs. applied force, respectively.

Another aspect of the invention is a method of manufacturing a string made of filaments composed of a polyamide impregnated with graphite particles. The string has a cross-sectional diameter between about 0.025 and 0.08 inch and is suitable for use in sports rackets, musical instruments, and other stringed apparatus.

The method comprises the steps of: heating a polyamide to a temperature between about 300° and 550° F.; mixing the polyamide with graphite particles until said particles are substantially distributed throughout said polyamide; extruding said polyamide mixed with graphite particles into filaments; cooling said filaments; and forming a string by fusing and entwining a plurality of said filaments. The method may further include the steps of filtering the polyamide to remove impurities and prestressing the filaments prior to string formation to substantially extend said filaments.

The polyamide is preferably heated to a temperature between about 450° and 500° F., and most preferred about 490° F. The extrusion is accomplished with a nozzle, such as a convergent or convergent-divergent nozzle, which has an orifice with a cross-sectional diameter from about 0.003 to about 0.01 inch. The filaments are preferably cooled in a bath having a temperature between about 10°–20° F., most preferably 14° F. The method is particularly useful for making tennis racket strings that are extremely strong and resilient, yet less likely to be damaged when subjected to high-moisture environments.

Other aspects and advantages of the present invention will become apparent from the following description of a preferred embodiment, taken in conjunction with the accompanying drawings, which disclose, by way of example, the principles of the invention.

DETAILED DESCRIPTION

Figure 1:
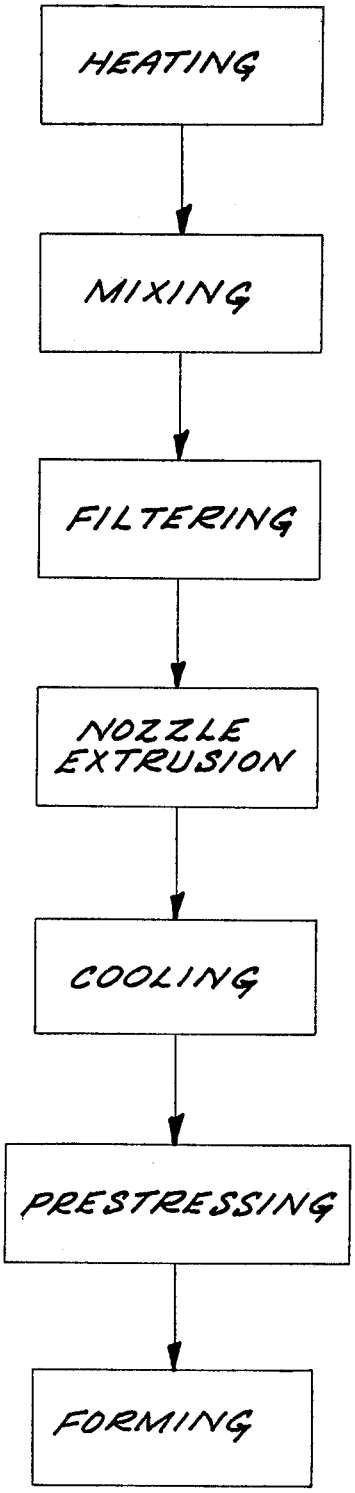
FIG. 1 is a flow chart which depicts the steps of a preferred manner of making a tennis string having high tensile strength, high resilience, and low elongation characteristics.
Figure 2:
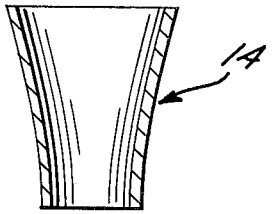
FIG. 2 is an enlarged, cross-sectional view of a convergent nozzle.
Figure 3:
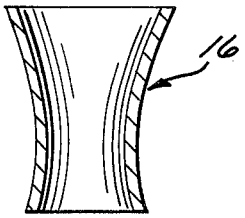
FIG. 3 is an enlarged, sectional view of a convergent-divergent nozzle.
Figure 4:
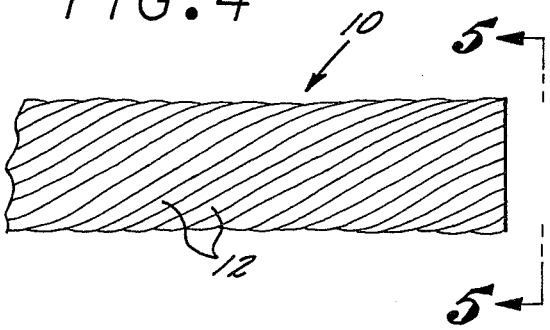
FIG. 4 is an enlarged, exterior view of a string embodying the present invention.
Figure 5:
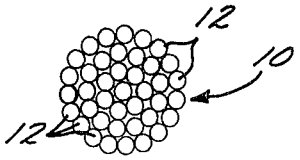
FIG. 5 is a sectional view taken substantially along the line 5—5 in FIG. 4.

As shown in the drawings for purposes of illustration, and particularly FIGS. 4 and 5, the present invention is embodied in a string, indicated generally by reference numeral 10, composed of a plurality of entwined, fused filaments 12. In strings for use in tennis rackets, it is highly desirable that the string have high tensile strength and resilience, and low elasticity, yet be substantially resilient to degradation by moisture.

In accordance with the present invention, the filaments 12 are composed of a synthetic polymer which has been impregnated with graphite particles to increase the tensile strength and improve playing characteristics. Further, string 10 of this invention is relatively inexpensive to manufacture, has good elasticity and resilience, and is not significantly damaged by exposure to a high moisture environment.

In an exemplary process, the following steps are utilized to manufacture a string 10 of the present invention:

(1) a synthetic polymer, such as a polyamide, is heated to a temperature between about 300° and 550° F., and preferably between about 450° and 500° F.;

(2) the polyamide is then mixed with graphite particles until the graphite particles are substantially distributed throughout the polyamide;

(3) the polyamide mixed with the graphite particles is extruded into filaments;

(4) the filaments are cooled; and (5) the filaments are fused and entwined to form a string.

Additionally, the polyamide may be filtered to remove impurities and the filaments prestressed for substantial extension before string formation, as is known in the art.

The polyamide is preferably a substantially linear polyamide such as a nylon. It is believed that when the substantially linear polyamide is impregnated with graphite particles, it is cross-linked, substantially in the absence of cleavage, providing increased tensile strength and other beneficial qualities.

The graphite particles range in size from about 0.1 to about 2.0 microns, and are present in a concentration from about 0.05 to about 2.0 weight percent, preferably from about 0.5 to about 1.5 weight percent. When the particles are substantially distributed throughout the polyamide, the resultant string has improved tensile strength when compared to untreated strings.

The extrusion of the polyamide impregnated with graphite particles into filaments is preferably accomplished through a nozzle. The nozzle, which has a passageway with a cross-sectional diameter between about 0.003 and about 0.01 inch, can have a convergent 14 or convergent-divergent 16 structure.

After extrusion the filaments are cooled, preferably in a bath maintained at a temperature between about 10° to 20° F. Thereafter, a plurality of the filaments, preferably between 49 and 79, are fused and entwined to form a string, as is well known in the art. Depending on the thickness and number of filaments utilized, a string of varying thickness can be made, although a typical string has a cross-sectional diameter ranging from about 0.025 to about 0.08 inch.

A string having a cross-sectional diameter between about 0.05 and about 0.06 inch made in accordance with the present invention exhibits a tensile strength greater than about 60,000 psi, a modulus of elasticity less than about $0.3\times10^6$ psi, and an elongation less than about 18% at the tension of the breaking point. The high tensile strength value indicates an increased utility life for the string and the lower elongation indicates a tendency for the strength to hold its original tension for a long time period. The low modulus of elasticity is indicative of improved playing characteristics.

A nylon string having a cross-sectional thickness of 0.054 inch in diameter is made as follows:

the nylon is heated to a temperature of about 490° F.;

the nylon is mixed with about 0.9 weight percent graphite particles, having a diameter ranging from about 0.1 to about 2.0 microns until the graphite particles are substantially dispersed;

the nylon is filtered to remove impurities;

the nylon is mixed with graphite particles and nozzle extruded into filaments having a cross-sectional diameter of about 0.02 inches;

the filaments are cooled by submersion in a bath maintained in a temperature of about 14° F.;

the filaments are prestressed to substantial extension; and a string having a cross-sectional diameter of about 0.054 inch is formed by fusing and entwining 79 of the filaments.

Such a string, which also has a surface coat of nylon impregnated with graphite particles, exhibits a tensile strength of about 63,900 psi, an elongation of about 17.1 percent at the tension of the breaking, a modulus of elasticity of about $0.268\times10^6$ psi and loss coefficients of about 7.5 percent at 50 pounds, about 9.8 percent at 60 pounds, about 11 percent at 70 pounds, and about 11.5 percent at 80 pounds applied force, respectively.

From the foregoing, it will be appreciated that the string of the present invention has high tensile strength and reduced elongation characteristics, yet maintains high resiliency. Further, the string is relatively inexpensive to manufacture, is substantially water resistant, and can significantly retain its improved characteristics even when strung at high tension in over-sized tennis rackets.

While a particular form of the invention has been illustrated and described, it will be apparent that various modifications can be made without departing from the spirit and scope of the invention.

I claim:

1. A filament comprising a polymer having an amount of graphite particles present throughout the entire volume of the filament sufficient to introduce significant polymer cross-linking substantially in the absence of polymer cleavage.

2. The filament of claim 1 wherein said filament has a cross-sectional diameter between about 0.003 and about 0.01 inch.

3. The filament of claim 1 wherein the polymer is a substantially linear polyamide.

4. The filament of claim 1 wherein the polymer is a nylon.

5. The filament of claim 4 wherein the nylon is impregnated with about 0.05 to about 2.0 weight percent graphite particles.

6. The filament of claim 4 wherein the nylon is impregnated with about 0.5 to about 1.5 weight percent graphite particles.

7. The filament of claim 4 wherein the nylon is impregnated with about 0.9 weight percent graphite particles.

8. The filament of claim 1 wherein the diameter of the graphite particles ranges from about 0.1 to about 2.0 microns.

9. A tennis racket string having a cross-sectional diameter of about 0.054 inch, said string comprising about 79 entwined, fused filaments, wherein said filaments consist essentially of substantially linear nylon having 0.9 weight percent graphite particles having a diameter ranging from about 0.1 to about 2.0 microns, said particles being present throughout the entire volume of the filament, and said string has a tensile strength of about 63,900 psi, an elongation of about 17.1% at the tension of the breaking point, modulus of elasticity of about $0.268 \times 10^6$ psi and loss coefficients of about 7.5% at 50 lbs., about 9.8% at 60 lbs., about 11% at 70 lbs., and about 11.5% to 80 lbs. applied force.

10. A string having a cross-sectional diameter from about 0.025 to about 0.08 inch and comprising a plurality of filaments having graphite particles present throughout the entire volume of the filament to increase the tensile strength of said filament.

11. The string of claim 10 wherein said filament is composed of a synthetic polymer.

12. The string of claim 11 wherein said polymer is a polyamide.

13. The string of claim 10 wherein said polymer is a nylon.

14. The string of claim 13 wherein said filament contains from about 0.05 to about 2.0 weight percent graphite particles.

* * * * *

UNITED STATES PATENT AND TRADEMARK OFFICE

CERTIFICATE OF CORRECTION

PATENT NO. : 4,395,458

DATED : July 26, 1983

INVENTOR(S) : Ben T. Huang

It is certified that error appears in the above-identified patent and that said Letters Patent is hereby corrected as shown below:

In The Specification:

Column 3, Line 18: Delete "resilient" and substitute therefor --resistent--

In The Claims:

Column 6, Line 3: Delete "to" and substitute therefor --at--

Signed and Sealed this

*Fifteenth* Day of *November 1983*

[SEAL]

*Attest:*

*Attesting Officer*

GERALD J. MOSSINGHOFF

*Commissioner of Patents and Trademarks*